US005597301A

United States Patent [19]

Roy et al.

[11] Patent Number: 5,597,301

[45] Date of Patent: Jan. 28, 1997

[54] BURNER EMISSION DEVICE

[75] Inventors: William J. Roy, Plainfield, Ind.; Thomas J. Legutko, Canastota, N.Y.

[73] Assignee: Carrier Corporation, Syracuse, N.Y.

[21] Appl. No.: 566,523

[22] Filed: Dec. 4, 1995

[51] Int. Cl.[6] ..... F23D 14/12

[52] U.S. Cl. ..... 431/347; 431/350; 431/171

[58] Field of Search ..... 431/347, 171, 431/172, 350

[56] References Cited

U.S. PATENT DOCUMENTS

| | | | |
|---|---|---|---|
| 951,060 | 3/1910 | Driessche | 431/347 |
| 3,787,169 | 1/1974 | Gjerde | 431/347 |
| 3,816,055 | 6/1974 | Lear | 431/347 |
| 4,904,179 | 2/1990 | Dnago et al. | 431/2 |
| 4,934,927 | 6/1990 | Swiatosz | 431/347 |
| 5,174,744 | 12/1992 | Singh | 431/347 |
| 5,244,381 | 9/1993 | Cahlik | 431/171 |
| 5,333,597 | 8/1994 | Kirkpatrick et al. | 126/110 R |
| 5,370,529 | 12/1994 | Lu et al. | 431/353 |
| 5,380,192 | 1/1995 | Hamos | 431/328 |

FOREIGN PATENT DOCUMENTS

| | | | |
|---|---|---|---|
| 3413968 | 10/1968 | Germany | 431/171 |

*Primary Examiner*—Carroll B. Dority

[57] ABSTRACT

A mixing/quenching device is in the form of a stack of perforate metal sheets secured together with the perforations aligned to define continuous flow paths. The interfaces of the laminations in the flow path provides turbulence and the thermal mass of the device provides heat transfer such that thermal $NO_x$ is reduced.

8 Claims, 3 Drawing Sheets

BURNER EMISSION DEVICE

BACKGROUND OF THE INVENTION

In the complete combustion of common gaseous fuels, the fuel combines with oxygen to produce carbon dioxide, water and heat. There can be intermediate reactions producing carbon monoxide and hydrogen. The heat, however, can also cause other chemical reactions such as causing atmospheric oxygen and nitrogen to combine to form oxides of nitrogen or $NO_x$. While $NO_x$ may be produced in several ways, thermal $NO_x$ is associated with high temperatures, i.e. over 2800° F. The flame is zoned so that different parts of the flame are at different temperatures. $NO_x$ production can be reduced with the lowering of the peak flame temperature. The reduction in $NO_x$ can be achieved through turbulence of the gases being combusted and/or by heat transfer from the high temperature portion of the flame.

SUMMARY OF THE INVENTION

The mixing/quenching device of the present invention is made from stacked perforate metal sheets which may be welded together and having aligned perforations. The stack provides the thermal mass necessary to provide limited quenching while also disrupting the flow and enhancing mixing. The aligned perforations define elongated cylindrical flow paths having much larger surface areas than the cross sections of the cylindrical flow paths. Accordingly, the flow is divided among these flow paths which increases contact with the stack to facilitate heat transfer. Turbulence is enhanced by the inherent roughness of the flow paths defined by the individual laminations of the stack at their interfaces as well as due to the recombining of the flows as they exit from the stack. The stack is located directly in the inshot flame to disrupt the standard flame flow and temperature profiles. These disruptions serve to break up fuel rich zones in the flame, increase surface area of the flame front and provide limited flame quenching.

It is an object of the invention to reduce the production of thermal $NO_x$.

It is another object of this invention to provide increased mixing and flame quenching of an inshot flame.

It is a further object to reduce emission dwell time.

It is another object of this invention to reduce $NO_x$ emissions without increasing CO production at multiple firing rates.

These objects, and others as will become apparent hereinafter, are accomplished by the present invention.

Basically, the flame impinges upon the perforate stack of laminations with the flow dividing and passing through the perforations and recombining. The stack quenches the flame by serving as a thermal mass. The stack also functions as a turbulator which enhances mixing. The combination of these two effects allows this device to lower emissions.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
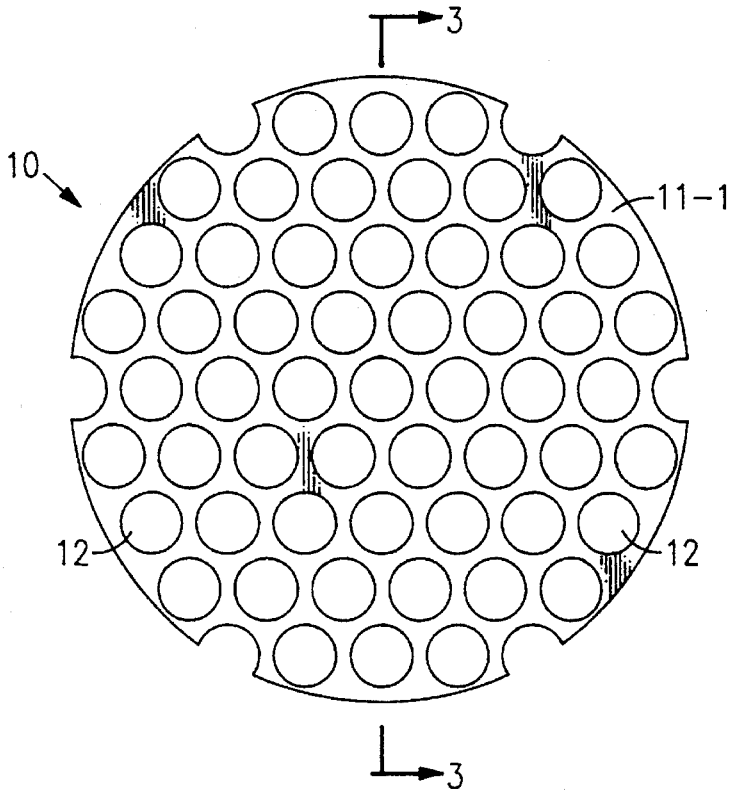
FIG. 1 is an end view of the stack.
Figure 2:
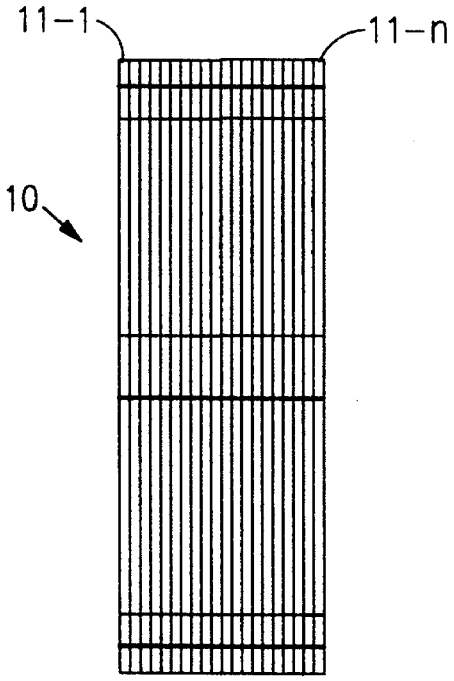
FIG. 2 is a side view of the stack.
Figure 3:
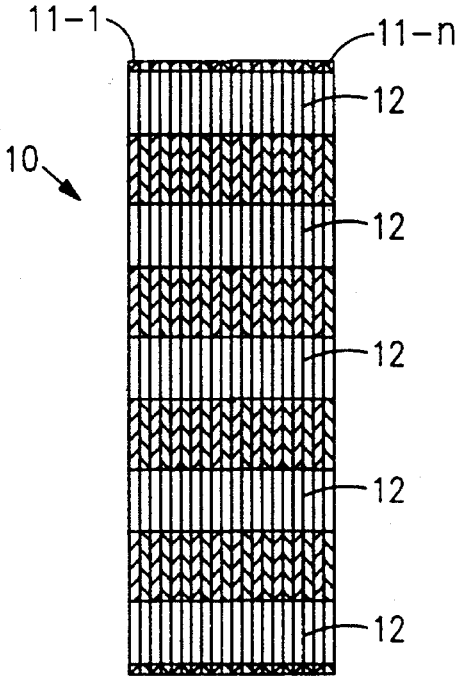
FIG. 3 is a sectional view taken along line 3—3 of FIG. 1.

In the Figures, the numeral 10 generally designates the quenching device of the present invention. Quenching device or stack 10 is made up of a plurality of laminations, 11-1 to 11-n, of perforate metal which are either pressed firmly together or welded together and having their perforations aligned to form elongated flow paths 12 in quenching device 10. In a typical device the height of the stack of laminations 11-1 to 11-n will be on the order of a half inch with n being on the order of eight to ten. The diameter of flow paths 12 will be on the order of 0.125 inches to 0.1875 inches with the centers of three mutually adjacent flow paths 12 forming an equilateral triangle with the vertices spaced at least 0.002 inches greater than the diameter of flow paths 12 and typically on the order of 0.1875 inches. The flow paths 12 have a length at least twice their diameters. The laminations 11-1 to 11-n are made of a suitable, heat resistant material such as 310 stainless steel. Laminations 11-1 to 11-n whether welded or pressed together are held in place by brackets 24 and 26 and form a single unit with the facing surfaces of the laminations in various stages of integral contact. The flow paths 12 have roughened surfaces inherent with the deformation of the material surrounding the punched out holes collectively forming paths 12 and due to the less than perfect alignment of the holes forming paths 12.

Figure 4:
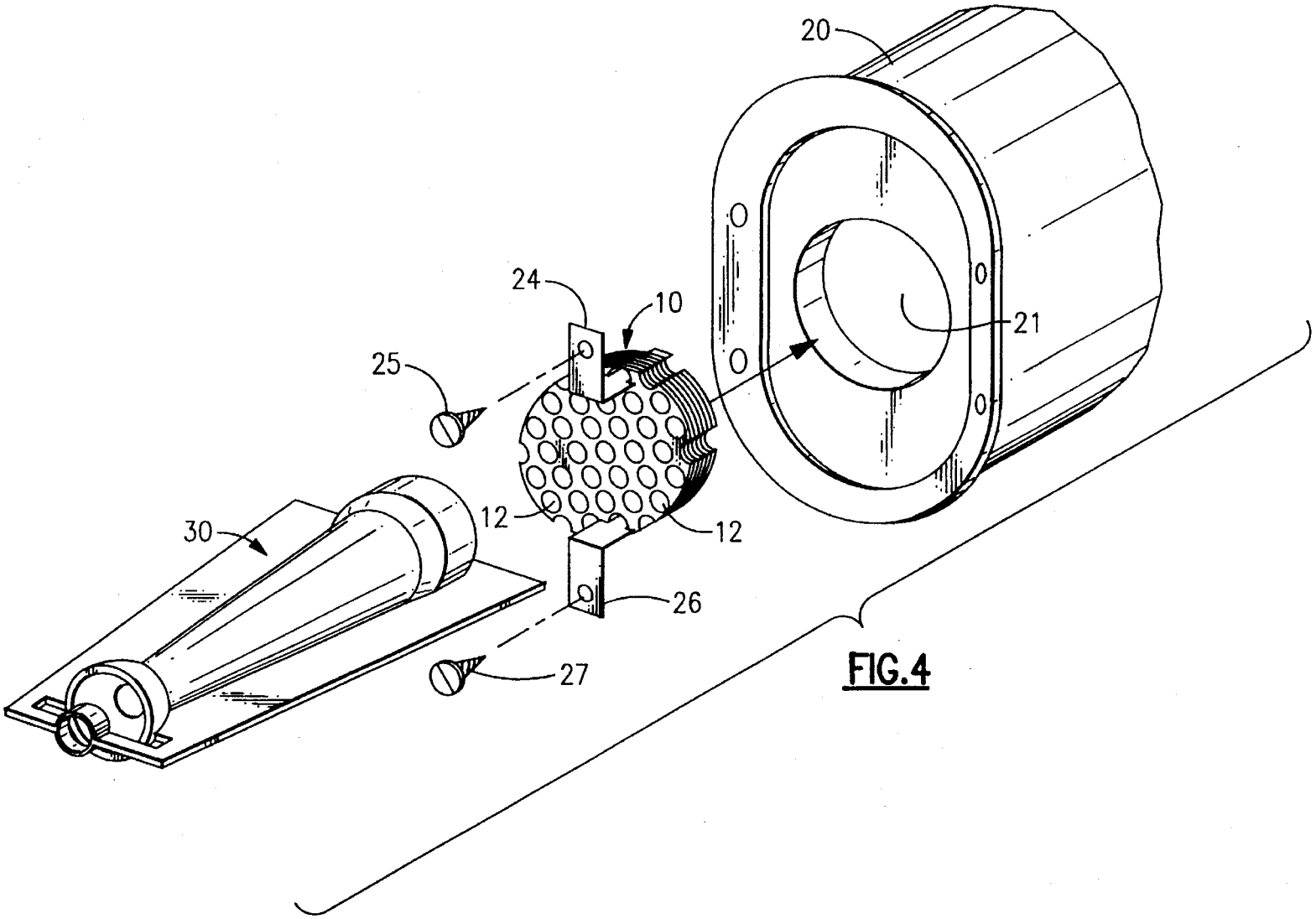
FIG. 4 is an exploded view of the burner, quenching device and heat exchanger.
Figure 5:
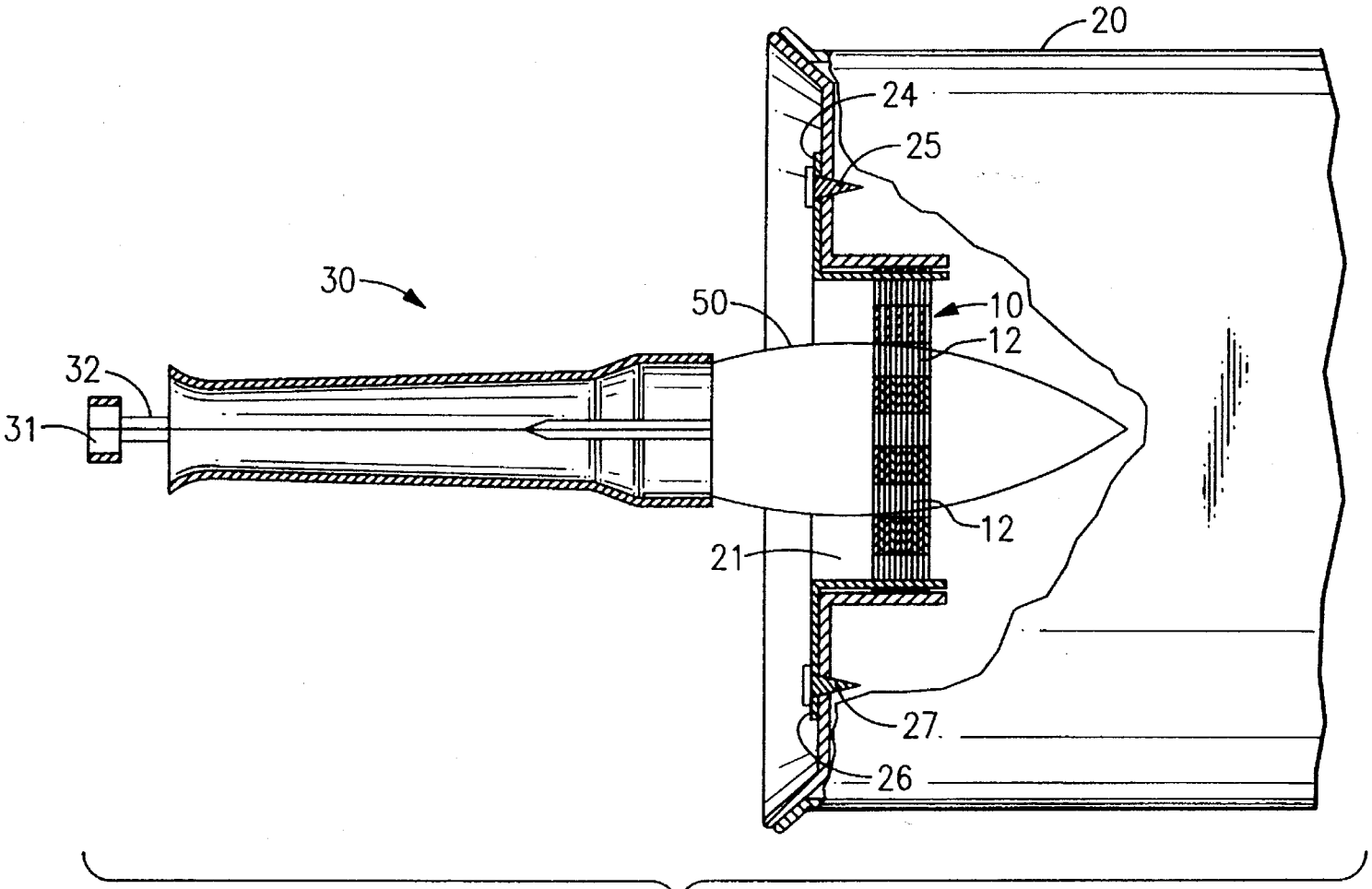
FIG. 5 is a sectional view of the burner, quenching device and heat exchanger in place.

Turning now to FIGS. 4 and 5, stack 10 is placed in the inlet 21 of heat exchanger 20 and secured by brackets 24 and 26 via screws 25 and 27, respectively. Inshot burner 30 is spaced from and faces stack 10 by a distance such that the stack 10 is in a position corresponding to the location of the tip of the inner cone of the flame from burner 30 in the absence of stack 10. Normally, the burner's flame goes into heat exchanger 20 so that stack 10 is in the normal area of the flame.

In operation, gaseous fuel is supplied under pressure to port 31 of burner 30. The gas supplied to port 31 passes annular opening 32 aspirating atmospheric air which is drawn into burner 30. The fuel air mixture exits burner 30 in flame 50. Flame 50 impinges upon stack 12 disrupting the standard flow and temperature profiles as the burning fuel-air mixture divides and passes through paths 12 and emerges therefrom as a flame. The disruption of the flow for passage through paths 12 and the roughness of the walls of paths 12 due to the laminations breaks up fuel rich zones in the flame and causes turbulence which promotes burning by increasing the surface area of the flame heat as well as providing limited quenching by heat transfer to the stack 10. The turbulence interferes with the establishment of a stable flame relative to the location of the inner and outer cone which results in the hottest part of the flame defined by the outer cone moving about. Additionally, the heat transfer to the stack 10 tends to equalize flame temperatures. The unstable flame and heat transfer through the stack 10 tends to lower the peak temperature and thereby reduce the production of thermal $NO_x$.

Although preferred embodiment of the present invention has been described and illustrated, other changes will occur to those skilled in the art. It is therefore intended that the scope of the present invention is to be limited only by the scope of the appended claims.

What is claimed is:

1. A burner emission device for reducing $NO_x$ comprising:

an inshot burner;

a heat exchanger;

a plurality of laminations each having a plurality of holes therein;

said plurality of laminations secured in a stack with said holes in each of said plurality of laminations aligned with corresponding holes in every other one of said plurality of laminations whereby said holes define a plurality of continuous flow paths through said stack;

said stack is located in said heat exchanger which is opposite and spaced from said burner with said burner facing said stack, whereby flow from said burner impinges upon said stack with said flow dividing in passing through said passages and engaging in heat exchange with said stack which defines a thermal mass such that quenching occurs and $NO_x$ production is reduced.

2. The device of claim 1 wherein said flow paths have a length to width ratio of at least 2.

3. The device of claim 1 wherein said plurality of lamination are metal.

4. The device of claim 3 wherein said metal is stainless steel.

5. The device of claim 1 wherein said plurality of lamination are secured in a stack by welding.

6. The device of claim 1 wherein interfaces between adjacent ones of said plurality of laminations causes turbulence in said plurality of the flow paths.

7. The device of claim 1 wherein said plurality of lamination are secured in a stack by mechanical means.

8. The device of claim 1 wherein the spacing of said burner from said stack is a distance such that a flame from said burner would extend through said stack during operation.

* * * * *